US005896349A

United States Patent [19]

Haze

[11] Patent Number: 5,896,349

[45] Date of Patent: Apr. 20, 1999

[54] CLOCK KIT

[76] Inventor: Richard Paul Haze, 688 Westshore Blvd., Pickering, Ontario, Canada, L1W 2T9

[21] Appl. No.: 08/833,087

[22] Filed: Apr. 4, 1997

[30] Foreign Application Priority Data

Apr. 10, 1996 [CA] Canada ..... 2174143

[51] Int. Cl.[6] ..... G04B 19/04

[52] U.S. Cl. ..... 368/228; 368/296

[58] Field of Search ..... 368/228, 233, 368/234, 296, 294

[56] References Cited

U.S. PATENT DOCUMENTS

| | | | |
|---|---|---|---|
| 1,768,100 | 6/1930 | Baumgarten | 368/228 |
| 5,077,709 | 12/1991 | Feher | 368/229 |
| 5,557,586 | 9/1996 | McCaun et al. | 368/228 |

*Primary Examiner*—Bernard Roskoski

[57] ABSTRACT

The clock has a dial which may be removed from a casing and replaced by a different dial. The dial is located behind the crystal of the clock and the hands are located outside the crystal.

1 Claim, 2 Drawing Sheets

CLOCK KIT

BACKGROUND OF THE INVENTION

The present invention relates to a clock kit, and in particular a clock kit of novel design.

Various kits for fabricating clocks are known but most are of such a design that they are too complicated for children, and others lacking sufficient manual dexterity, to assemble. If of simple design, they do not allow the person assembling the kit a choice of dial materials, control of the final appearance of the dial, and hence, the appearance of the finished clock. Also because the dial is handcrafted and may be of a delicate nature, separation of the dial from its environment is necessary.

An example of a clock kit, which has a construction that might be too complicated for those with limited manual dexterity and also does not afford dial protection is described in U.S. Pat. No. 3,889,806 dated Jun. 17, 1975 granted to Frank P. Casella. An example of a clock which offers changeability but which offers no protection for the dial, no chance for the assembler to finish the dial to his/her own tastes, and because of its design, limits dial materials to those flexible enough to be folded, is U.S. Pat. No. 5,396, 474 dated Mar. 7, 1995, granted to Jay Lin.

Another example of a clock where changeability might be attained, but which offers no protection to the dial, no chance for the assembler to finish the dial to his/her own tastes, and limits the material from which the dial can be made because rigidity is necessary to property affix the dial to the casing, can be found in U.S. Pat. No. , 4,718,773 dated Jan. 12, 1988, granted to Colin N. O'Donoghue.

In view of the shortcomings of the known art, the inventor has designed a clock kit, which due to its simplicity and variability make it useable by those who have limited knowledge or skill in the filed of dial or clock making The dial can be finished to the specifications and colour choices made by the assembler.

The primary objective of this invention is to provide a clock kit with a dial which can be finished to the taste of any person with rudimentary artistic skills.

SUMMARY OF THE INVENTION

The clock itself consists of an exterior casing into which is fitted a dial. The dial in the original kit will have on its surface either reference markings where numerals should be (allowing the assembler to draw their own numerals), or impressions of the numerals which the kit assembler can colour. In the case of those whose craft is cross-stitch, embroidery, or needlepoint, a suitable material with the impression of a clock dial will be provided. As well dials may or may not have outlined ornamentation.

The dial is held in the casing by the clock movement, the shaft of which passes through a hole in both the dial and the clock casing. The casing can be made in a variety of shapes to satisfy various tastes, some examples of which might be circular, oval, square or rectangular.

The competed dial will be protected by the casing, and thus the choice of dial materials is virtually unlimited. It can range from paper, to cardboard, to plastic which can be drawn upon, to just about any semi-rigid material.

Further objectives along with their advantages will become evident through careful reading of the detailed description given hereinbelow, with appropriate reference to the accompanying diagrams.

DESCRIPTION OF PREFERRED EMBODIMENTS

Figure 1:
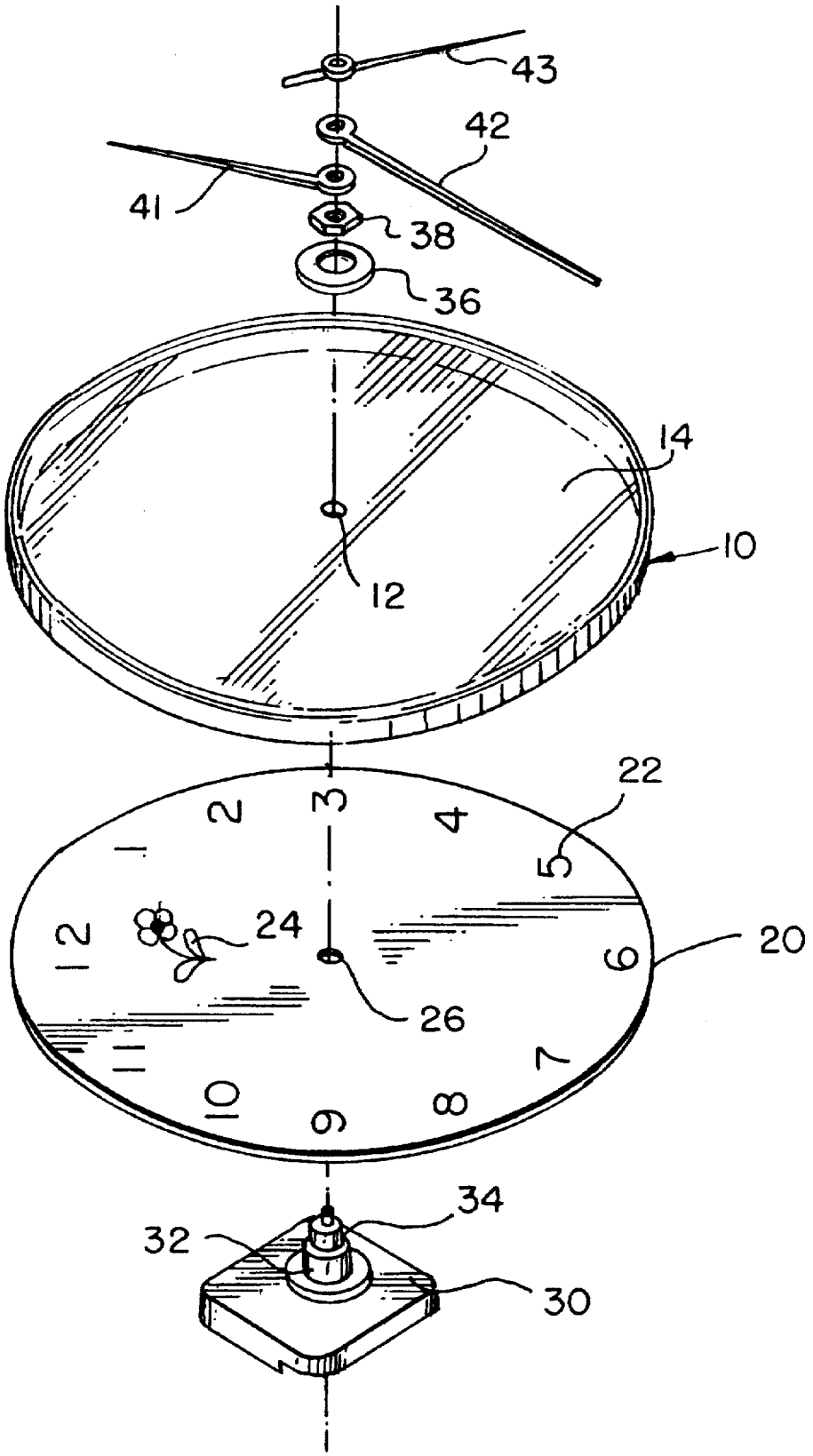
FIG. 1 is an exploded view of the clock assembly.
Figure 2:
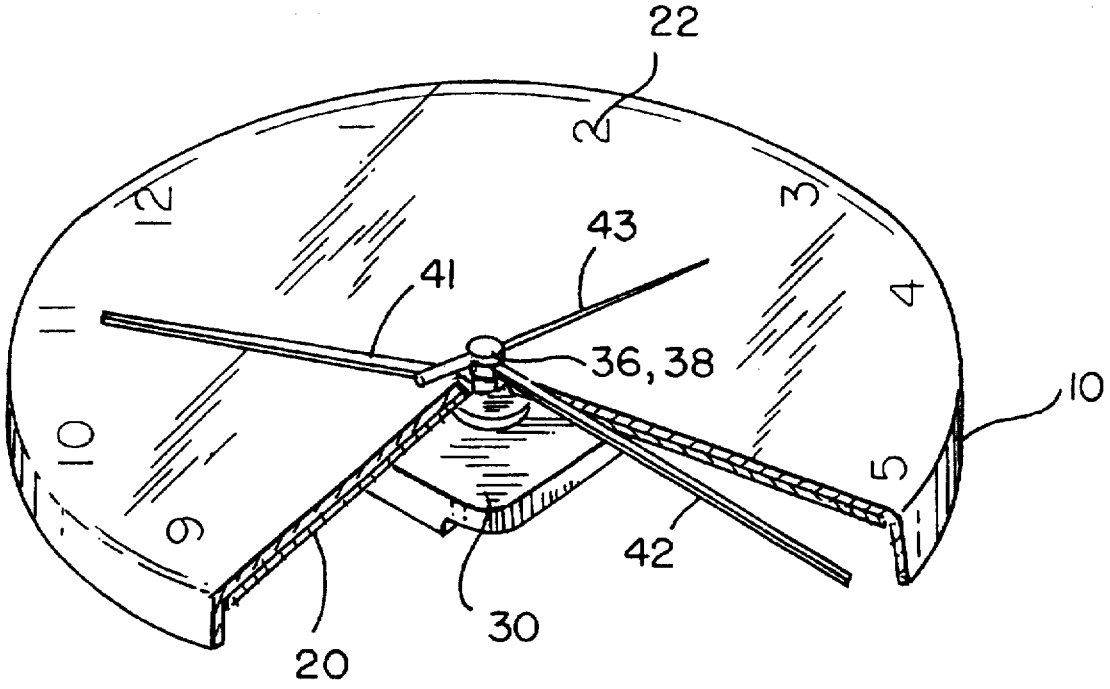
FIG. 2 is a perspective view of a clock assembly in accordance with the present invention, with a cutout to allow clear viewing of the interior.

Referring to the drawings a clock assembly in accordance with the present invention is comprised of: an outer casing 10 with a centre hole 12 made of plastic or another material which allows for transparency of the front or crystal 14; a dial 20 which has the outline of the numerals 22, ornamentation 24 and a centre hole 26 and is made of a sheet material that is appropriate for the choice of treatments that the assembler wishes to use to achieve the desired results; a clock body or drive mechanism 30 including a fixed member 32 with nested shafts or rotating means 34; a washer 36; a proper fastener 38; and pointers 41, 42, 43.

The fixed member 32 and the nested drive shafts 34 are passed, from the back through both the centre hole 26 in the dial and the centre hold 12 in the casing 10. The fixed member is fastened using a washer 36 and a proper fastener 38 and pointers 41, 42, 43 are then attached to the nested shafts 34.

Some examples of the sheet materials used for the dial might be paper, for those who wish to use crayons, pencil crayons, pen and ink, or markers of another sort; plastic canvas (for needlepoint); aida cloth or other material used in the craft called cross-stitch; cardboard; plastic (which can be drawn or painted upon); or cloth which has been stiffened using a proper medium.

Although the invention has been described with a certain degree of particularity, it is to be understood that the present disclosure has been made by way of example only and that many changes in the detailed construction and the arrangement and combination of the parts may be resorted to without departing from the scope and spirit of the invention hereinafter claimed.

I claim:

1. A clock having an interchangeable dial comprising:

a drive mechanism having a rotating shaft;

a casing having a transparent crystal;

a dial adjacent to said crystal removably mounted within said casing and being separate and apart from said crystal, said dial having a face visible through said crystal, said dial being disposed between said crystal and said drive mechanism, said crystal and said dial each having a hole within which said shaft is received, said holes being disposed centrally of said dial and crystal and being in register with each other;

a pointer disposed on the side of said crystal opposite that of said dial;

a fastener rotatably mounted to said shaft such that rotation of said fastener in one direction causes said fastener to move into contact with said pointer to thereby cause said pointer to rotate with said shaft, and rotation of said fastener in the opposite direction serves to remove said fastener from said shaft such that said pointer, said casing and said dial being removable from said shaft so that said dial may be interchanged with a different dial.

* * * * *